US006412922B1

(12) United States Patent
Mantell et al.

(10) Patent No.: US 6,412,922 B1
(45) Date of Patent: Jul. 2, 2002

(54) SUPPORT STRUCTURE FOR LARGE CHANNEL PLATES OF AN INK JET PRINTHEAD

(75) Inventors: David Allen Mantell; Lisa A. Delouise, both of Rochester, NY (US); James F. O'Neill, Rock Hill, SC (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/725,297

(22) Filed: Nov. 29, 2000

(51) Int. Cl.[7] ..... B41J 2/05
(52) U.S. Cl. ..... 347/65
(58) Field of Search ..... 347/63, 65, 92, 347/44, 47, 67, 93; 216/27; 29/290.1

(56) References Cited

U.S. PATENT DOCUMENTS 5,041,190 A * 8/1991 Drake et al. ..... 347/65

FOREIGN PATENT DOCUMENTS

JP 4-118246 * 4/1992 ..... 347/65

* cited by examiner

*Primary Examiner*—John Barlow
*Assistant Examiner*—Juanita Stephens
(74) *Attorney, Agent, or Firm*—Oliff & Berridge, PLC; Eugene Palazzo

(57) ABSTRACT

An ink jet printhead includes an ink reservoir having an fluid inlet for receiving ink, a top portion, and a bottom portion. A channel plate structure that is etched from silicon defines a plurality of microchannels in fluid communication with the reservoir for directing ink from the reservoir. Support structure is provided near the top portion of the reservoir and extending within the reservoir. The support structure is formed to divide the reservoir into at least a pair of reservoir regions and to provide support to the channel plate structure while permitting substantially unobstructed fluid flow to all of the channels at the bottom portion of the reservoir. In addition to forming printheads for ink jet printers, the invention may be applied to other microchannel fluidic devices.

15 Claims, 2 Drawing Sheets

SUPPORT STRUCTURE FOR LARGE CHANNEL PLATES OF AN INK JET PRINTHEAD

FIELD OF THE INVENTION

This invention relates to microchannel fluidic devices, such as an ink jet printhead, but more particularly, to support structures for supporting large channel plates while allowing fluids to flow through microchannels of a printhead.

BACKGROUND OF THE INVENTION

As the size of printheads increases, the ink reservoir region of the channel plate of the printhead will also increase in size. This size increase may make the channel plate fragile and prone to cracking failure during etching, bonding or dicing. One solution is to divide the reservoir into a multiple smaller reservoirs. With reference to FIG. 1, a conventional ink jet printhead, generally indicated at 10, includes ink inlets 12, an ink reservoir 14, a channel plate 15 defining a plurality of channels 16, and support structure 18. The support structure 18 separates the reservoir 14 into multiple regions, but air bubbles caught in the reservoir 14 tend to pinch-off ink flow to the channels at the end 20 of the support structure 18. Reduced ink flow to channels is not acceptable when multiple small reservoirs are provided because the channels at the ends of the small reservoirs are in the middle of the printhead 10 and, as a result, may not be usable for printing. This phenomenon presents itself in other microchannel fluidic devices, a printhead being discussed herein as one example of an application of the present invention.

Accordingly, there is a need to provide support structure which will lend structural support to a channel plate while allowing ink or other fluid to flow to the channels in the middle of the channel plate.

SUMMARY OF THE INVENTION

An object of the present invention is to fulfill the need referred to above. In accordance with the principles of the present invention, this objective is attained by providing, in one application of the invention, an ink jet printhead including an ink reservoir having an inlet for receiving ink, a top portion and a bottom portion. A channel plate structure defines a plurality of channels in fluid communication with the reservoir for directing ink from the reservoir. Support structure is provided near the top portion of the reservoir and extends within the reservoir. The support structure is constructed and arranged to divide the reservoir into at least a pair of reservoir regions and to provide support to the channel plate structure while permitting substantially unobstructed ink flow to all of the channels at the bottom portion of the reservoir.

In accordance with another aspect of the invention a method of modifying a support structure for a channel plate of, by way of example, an ink jet printhead provides an ink reservoir having an inlet for receiving ink, a bottom portion and a top portion. A channel plate is provided having a plurality of channels to direct ink from the reservoir. The method includes providing support structure at the top portion of the reservoir so as to extend into the reservoir and having an end portion spaced from the bottom of the reservoir. The support structure is constructed and arranged to divide the reservoir into at least a pair of reservoir regions and to provide support to the channel plate. A portion of the support structure which extends into the reservoir is removed to define a remaining end portion of the support structure within the reservoir. The remaining end portion is spaced from the bottom portion of the reservoir a distance greater than a distance the end portion is spaced from the bottom portion of the reservoir, thereby permitting substantially unobstructed ink flow to all of the channels at the bottom portion of the reservoir.

In accordance with yet another aspect of the invention, a method of providing a support structure for a channel plate of an ink jet printhead provides an ink reservoir having an inlet for receiving ink, a bottom portion and a top portion. A channel plate is provided having a plurality of channels to direct ink from the reservoir. Support structure is disposed at the top portion of the reservoir so as to extend into the reservoir behind the channels. The support structure is constructed and arranged to divide the reservoir into at least a pair of reservoir regions, to provide support to the channel plate, and to permit substantially unobstructed ink flow to all of the channels.

Other objects, features and characteristics of the present invention, as well as the methods of operation and the functions of the related elements of the structure, the combination of parts, and economics of manufacture, will become apparent upon consideration of the following description of illustrative embodiment and appended claims with reference to the accompanying drawings, all of which form a part of this specification.

BRIEF DESCRIPTION OF THE DRAWINGS

Reference is made to the attached drawings relating, by way of example, to an exemplary ink jet printhead wherein elements having the same reference numeral designations represent like elements throughout and wherein.

DESCRIPTION OF ILLUSTRATIVE EMBODIMENTS

Support structures for microchannel fluidic devices formed by etching a wafer of silicon or other materials are usually etched from the inside or underside of the wafer. Ink reservoirs for normally pyramid-shaped large monolithic printheads are formed by partially etching dividers on a channel plate mask. One way to accomplish this is to start with a discontinuous divider pattern in the reservoir mask. During etching, the divider pattern is undercut, leaving open the bottom of the reservoir but adding structural support provided by walls and a top portion of the structure. The reservoirs and supporting structures may, of course, be formed by other methods and in other geometrical shapes. The present disclosure exemplifies one such method, but is not limited thereto.

Figure 1:
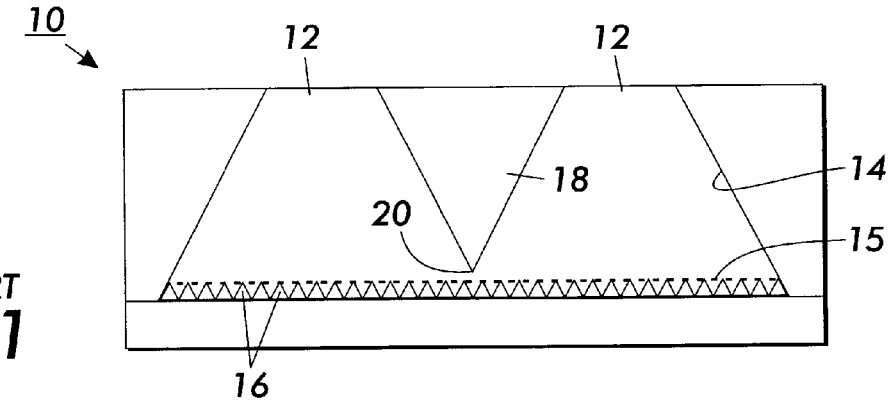
PRIOR ART FIG. 1
FIG. 1 is a schematic illustration of a section of the front of a conventional ink jet printhead having a support structure extending within the reservoir thereof.
Figure 2:
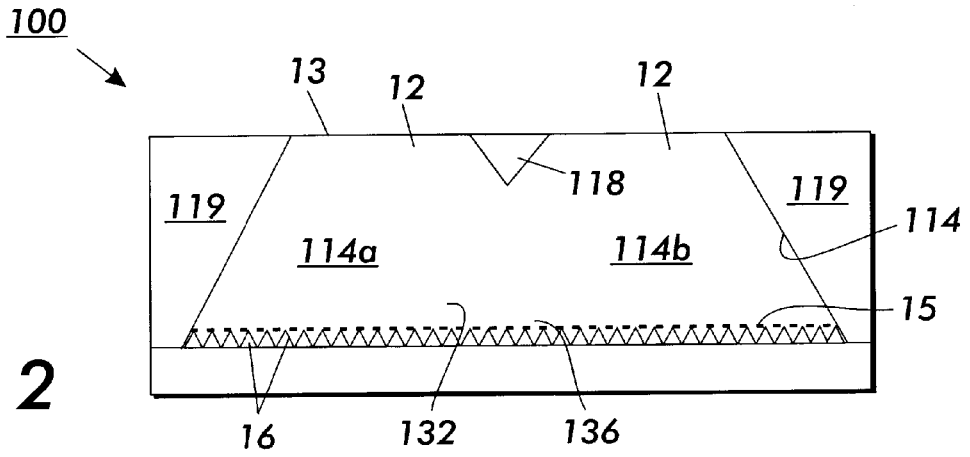
FIG. 2 is a schematic illustration of a section of a front of a printhead having a modified support structure which permits ink flow in the middle of the printhead in accordance with the principles of the invention.

Referring to FIG. 2, a large ink jet printhead is shown, generally indicated 100, provided in accordance with the principles of one application of the present invention. The printhead is preferably of, but not limited to, the monochromatic type. The printhead 100 is similar to the conventional printhead of FIG. 1, but, the support structure is modified as explained below.

In the conventional manner as disclosed, for example, in U.S. Pat. No. 5,041,190, the contents of which is hereby incorporated by reference into the into the present specification, a two-sided polished, (100) silicon wafer is used to produce a channel plate 15, having a plurality of channels, of the printhead 100. As shown in FIG. 2, printhead 100 includes an ink reservoir 114 for receiving ink through fluid inlets 12 at a top portion 13 thereof. A support structure 118 is provided near the top portion 13 and extends within the reservoir 114 near a middle thereof to divide the reservoir into at least two regions 114*a* and 114*b*. The support structure 118 functions to provide support to the channel plate 15 via the top portion 13 of the reservoir and in conjunction with walls 119 of the reservoir.

In accordance with one aspect of the invention, the support structure 118 results from modifying the support structure 18 of the conventional printhead shown in FIG. 1. Thus, a portion of the support structure 18 of FIG. 1 which extends into the reservoir 114 is undercut to define the modified support structure 118 of FIG. 2 which provides an open bottom portion 132 of the reservoir 114 behind the channels 16 thereby permitting unobstructed ink flow to all channels, especially the channels 16 near the middle of the channel plate 15.

Figure 3:
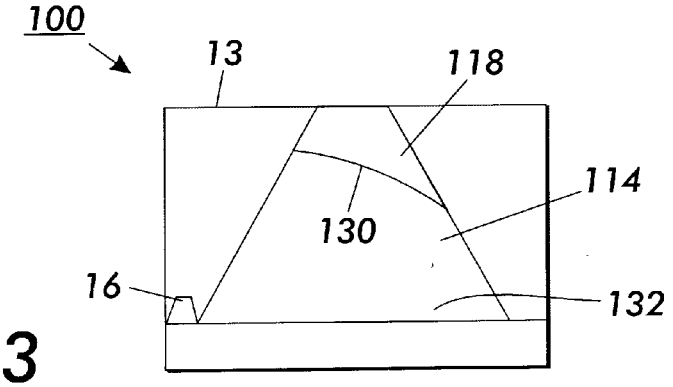
FIG. 3 is a side view of the printhead of FIG. 2.
Figure 4:
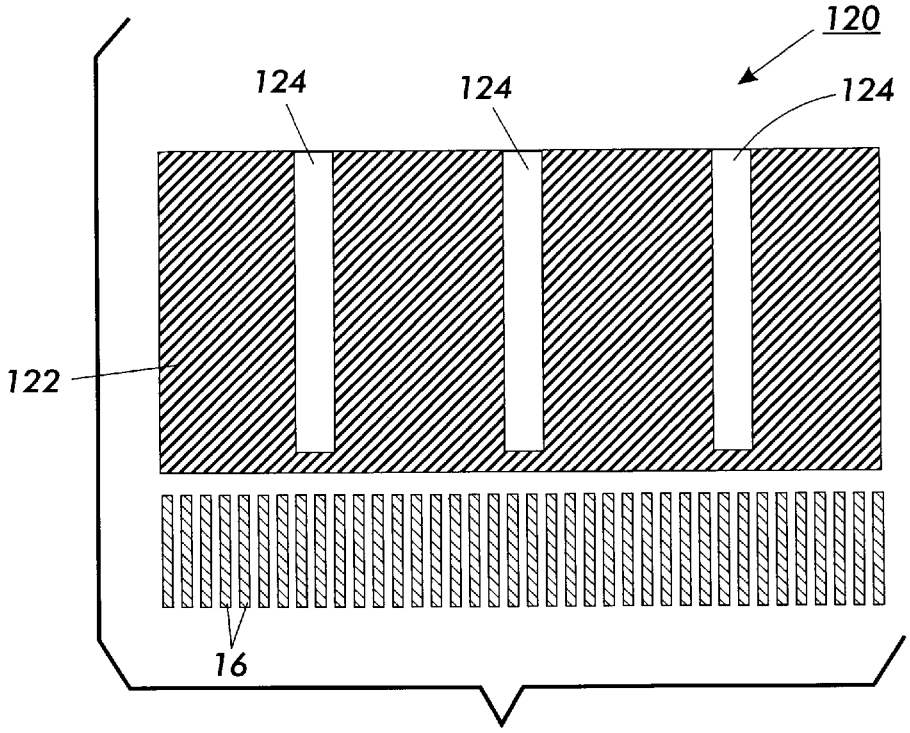
FIG. 4 is a plan view of a channel mask layout in accordance with a first embodiment of the invention to provide the support structure of FIG. 2.

One method of undercutting the conventional support structure 18 of FIG. 1 is to employ an etching process. As shown in FIGS. 2 and 3, a support structure 118 is defined by the design of the channel plate level mask 120 in the reservoir region as shown, for example, in FIG. 4. The mask opening is indicated at 122 and a plurality of fingers 124 are defined in the mask. The fingers 124 are sacrificial regions in the mask and are defined as convex members and are thus etched away during the etching process to define modified support structures 118 of FIG. 2. An etching process suitable for the invention is described, for example, in the above-incorporated U.S. Pat. No. 5,041,190. In the time needed to open up fluid inlet regions 12 on the other side of the silicon wafer, the regions under the fingers 124 will not be etched to completion, though the finger part of the mask can be completely undercut in this time. Thus, the end portion 20 of the conventional support structure 18 (FIG. 1) is etched away to define the support structure 118 having a vaulted or curved surface 130 spaced a distance from the bottom portion 132 of the reservoir 114 greater than a distance end portion 20 of the conventional support structure 18 is spaced from the bottom of the reservoir 14. Support structure 118 need not be formed curved or vaulted, but may take on other shapes to achieve a supporting function. The channels 16 are defined during a second etching process.

Thus, after etching, the bottom portion 132 of the reservoir 114 immediately behind the channels 16 will remain open but the support structure 118 remains at the top portion 13 of the reservoir 114.

The timing of the reservoir etch is important but not critical since the overall dimensions of the support structure 118 are not critical.

The length of the fingers 124 determines the size of the exemplary vaulted or curved regions 130 across the fluid inlet zone. Short fingers can be added to the channel side of the reservoir 114 that do not create vaults to add structural stability to that reservoir wall.

Figure 5:
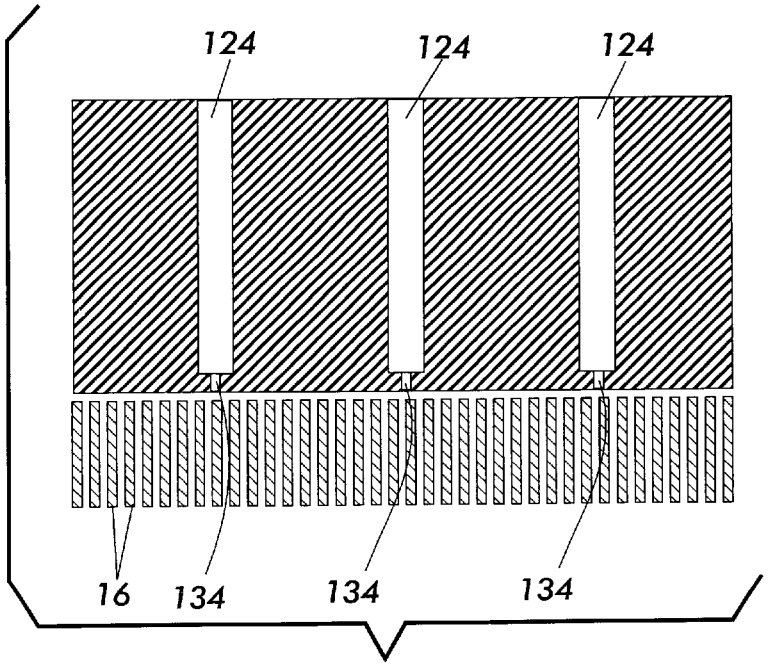
FIG. 5 is a plan view of a channel mask layout in accordance with a second embodiment of the invention to provide the support structure of the invention.

A way to reduce the undercutting of the support structure 118 and thus make a larger support structure 118 (but smaller than the conventional support structure 18) is to provide a narrow connecting structure 134. FIG. 5 shows the narrow connecting structures and the larger fingers 124 combined. Of course the narrow connecting structures 134 can extend across the entire reservoir. The connecting structures 134 are undercut slowly during the etching process. Typically, about 12 microns, more or less, are consumed in the time needed to etch the reservoir 114, depending on the thickness of wafer and other parameters known in the art, such as the type of etchant, temperature, etc. Mask structures narrower than 12 microns will be completely consumed, at which point the conventional support structure 18 will begin to be etched away to define the modified support structure 118.

The etching of the channel 16 can also be tailored to increase or decrease the additional amount of undercutting of the conventional support structure 18 to produce the modified support structure 118. By extending the etch time in the second etch, the undercutting of the support structure 18 can be increased from about 10 minutes, more or less, for a 600 dpi etch to 20 or 30 minutes. Likewise, the undercutting of the support structure 18 during the channel etch can be reduced by using isopropanol in the etch solution and etching at slightly lower temperatures. As known in the art, these specifications and chemical additives may vary according to the desired etching results. In addition, rather than etching a conventional structure as shown in FIG. 1, the entire structure of FIG. 2 may be etched together or in other successive steps. Thus, the invention is not limited to the particular etching process illustrated herein.

As noted above, due to the support structure 118 resulting from an undercut, an open bottom 132 is provided in the reservoir 114 permitting substantially unobstructed fluid flow to the channels 16 near the middle 136 of the channel plate 15. Furthermore, the support structure 118 of the invention increases the volume in the reservoir 114 to receive a bubble and therefore improve bubble management, heat management, and fluid management.

The formation of support structure 118 has been described by modifying the conventional support structure 18. However, it can be appreciated that the support structure 118 can be configured as described above by using appropriate masking and etching techniques without the need to modify an existing support structure 18.

The foregoing preferred embodiments have been shown and described for the purposes of illustrating the structural and functional principles of the invention as applied to an ink jet printhead, as well as illustrating the methods of employing the preferred embodiments. The general aim of the invention is to provide methods and structure to produce varying shapes for dividers which lend structural support for larger microchannel fluidic devices and to facilitate bubble management, yet allow fluid to flow to the jets in the middle of the resulting microchannel device. Based on the teachings herein, the application, methods, structures may be changed without departing from such principles. Therefore, this invention includes all modifications encompassed within the spirit of the following claims.

What is claimed is:

1. An ink jet printhead comprising:

an ink reservoir having an inlet for receiving ink, a top portion and a bottom portion, a channel plate structure defining a plurality of channels in fluid communication with the reservoir for directing ink from the reservoir, and support structure near the top portion of the reservoir and extending within the reservoir, the support structure being constructed and arranged to divide the reservoir into at least a pair of reservoir regions and to provide support to the channel plate structure while permitting substantially unobstructed ink flow to the channels at the bottom portion of the reservoir.

2. The printhead of claim 1, wherein the support structure has a curved surface defining an end portion thereof which extends into the reservoir.

3. The printhead of claim 1, wherein the printhead is a monochromatic printhead.

4. The printhead of claim 1, wherein the channel plate structure is silicon.

5. The printhead of claim 1, wherein the support structure is defined by an etching process that is timed during formation of the channel plate structure.

6. The printhead of claim 1, wherein the support structure is defined by a channel plate level mask that is completely undercut by an etching process.

7. The printhead of claim 1, wherein the support structure is located near a middle of the reservoir.

8. A method of forming a support structure for a channel plate of an ink jet printhead comprising:

providing an ink reservoir having an inlet for receiving ink, a bottom portion and a top portion, providing a channel plate having a plurality of channels to direct ink from the reservoir, providing support structure at the top portion of the reservoir that extends into the reservoir and that has an end portion spaced from the bottom of the reservoir, the support structure being constructed and arranged to divide the reservoir into at least a pair of reservoir regions and to provide support to the channel plate, and removing a portion of the support structure which extends into the reservoir to define a remaining end portion of the support structure within the reservoir, the remaining end portion being spaced from the bottom portion of the reservoir a distance greater than a distance the end portion was spaced from the bottom portion of the reservoir, thereby permitting substantially unobstructed ink flow to the channels at the bottom portion of the reservoir.

9. The method of claim 8, wherein the removing step includes etching the portion of the support structure.

10. The method of claim 9, wherein a mask is used in etching the portion of the support.

11. The method of claim 9, wherein the etching step includes undercutting said portion of the support structure to define said remaining end portion having a curved surface.

12. The method of claim 9, wherein the etching step includes etching said portion so that the bottom portion of the reservoir behind the channels is unobstructed.

13. The method of claim 8, wherein the channels are provided by an etching process.

14. A method of providing a support structure for a channel plate of a microchannel fluidic device comprising:

providing an fluid reservoir having an inlet for receiving fluid, a bottom portion, and a top portion;

providing a channel plate having a plurality of channels to direct fluid from the reservoir;

providing support structure at the top portion of the reservoir so as to extend into the reservoir, the support structure being formed to divide the reservoir into at least a pair of reservoir regions, to provide support to the channel plate, and to permit substantially unobstructed fluid flow to the channels at the bottom portion of the reservoir.

15. The method of claim 14, wherein the step of providing the support structure includes an etching process.

* * * * *